United States Patent [19]

Bieschke

[11] Patent Number: 4,492,422

[45] Date of Patent: Jan. 8, 1985

[54] WIRE CLAMP ASSEMBLY

[75] Inventor: Martin Bieschke, Rockford, Ill.

[73] Assignee: Textron Inc., Providence, R.I.

[21] Appl. No.: 448,479

[22] Filed: Dec. 10, 1982

[51] Int. Cl.[3] ..... H01R 11/20

[52] U.S. Cl. ..... 339/95 R; 339/246

[58] Field of Search ..... 339/95 R, 95 A, 246

[56] References Cited

U.S. PATENT DOCUMENTS

| | | | |
|---|---|---|---|
| 3,177,456 | 4/1965 | Haydu et al. | 339/95 |
| 3,398,393 | 8/1968 | Cochrum | 339/246 |
| 3,816,820 | 6/1974 | Stanaitis | 339/263 |
| 3,891,296 | 6/1975 | Gutshall | 339/246 |
| 4,135,777 | 1/1979 | Barth | 339/95 R |
| 4,146,289 | 3/1979 | Kirrish | 339/95 |

FOREIGN PATENT DOCUMENTS

| | | |
|---|---|---|
| 624606 | 1/1971 | Japan . |
| 97244 | 8/1972 | Japan . |
| 117182 | 3/1976 | Japan . |

*Primary Examiner*—John McQuade
*Assistant Examiner*—Paula Austin
*Attorney, Agent, or Firm*—Trexler, Bushnell & Wolters, Ltd.

[57] ABSTRACT

There is disclosed a wire clamp assembly for a terminal member of the type including a fastener member and a clamping member. The clamping member including a plate-like washer having a central aperture for receiving said fastener to be urged thereby toward said terminal member. The surface of the washer facing the terminal member has rib means formed thereon which are disposed substantially radially with respect to the axis of said aperture. Said rib means define at least two spaced apart protruding surfaces proximate at least one side of said washer, each said surfaces including a pair of edges for bitingly engaging a wire to be retained substantially simultaneously in multi-point contact in response to advancement of said washer toward said terminal member by said fastener.

14 Claims, 8 Drawing Figures

WIRE CLAMP ASSEMBLY

BACKGROUND OF THE INVENTION

This invention relates generally to wire clamp assemblies for electrical terminals and more particularly to a screw and washer wire clamp assembly for holding one or more wires in an engagement with a generally flat surface of a terminal block or the like.

Screw and washer type clamp assemblies including a screw for threadably engaging an internally threaded terminal member and a clamping washer advanced by the screw to clamp a wire to the terminal member surface are known in the art. For example, attention is directed to U.S. Pat. Nos. 3,177,456 and 3,816,820 and 4,146,289 which disclose clamp assemblies of this general type.

Many of the clamping washer members heretofore devised, however, do not sufficiently positively engage the wire to prohibit lateral or axial movement or twisting thereof after clamping, which may lead to mechanical or electrical failure of the connection. As a practical matter, resistance to extruding action in the wire during "pull-out" tests such as the UL 486 test must meet certain standards to gain approval of the terminal clamp device. Devices which fail to pass such tests are usually unsaleable.

Moreover, many clamping members are designed for connecting wires only in a limited range of sizes and are virtually inoperable when two wires of different sizes are to be connected to the same terminal. Various clamping washers heretofore designed for use in assemblies meeting the foregoing requirements have been relatively complex and correspondingly difficult and expensive to manufacture.

Additionally, it is important to make some provision in the terminal assembly and preferably in the clamping device itself for holding the clamped wire or wires out of excessive engagement with the screw portion of the assembly. In this regard, excessive contact with the screw threads during assembly and disassembly of wires with a terminal may cause damage to the wires, ultimately leading to mechanical or electrical failure of the installation. One particularly advantageous device which solves many of the foregoing problems is shown in U.S. Pat. No. 4,146,289. While this device has proven advantageous in use and has gained wide market acceptance, there remains room for further improvement.

In particular, it has been found that the pull-out resistance of such a clamping device may be surprisingly increased by the expedient of providing for a multi-location, tapered contact of the clamping washer with the wire to be clamped. Such multi-location engagement not only enhances the pull-out resistance of the wire but also enhances the resistance to forces tending to swivel the wire generally about the axis of the screw member of the assembly.

OBJECTS AND SUMMARY OF THE INVENTION

Accordingly, it is a general object of this invention to provide a new and improved screw and washer type of wire clamp assembly which is adapted for making simple yet secure mechanical and electrical connections between a wire and a terminal.

Another object of this invention is to provide a wire clamp assembly of the foregoing type which is further adapted to provide a multi-location contact with a wire which greatly enhances both the pull-out resistance and resistance to swiveling of the completed connection.

A related object is to provide a wire clamp assembly of the foregoing type which is relatively simple to assemble with a terminal member and is also relatively simple and inexpensive to manufacture, and yet highly reliable in operation.

Briefly, and in accordance with the foregoing objects, a wire clamp assembly for use with an internally threaded terminal member having a flat conductive surface comprises a screw member having an externally threaded portion for engagement with said internal thread of the terminal member, a driver head and an unthreaded shank portion intermediate the driver head and threaded portion. A plate-like washer or clamping member is mounted on the unthreaded shank portion preferably in captive relation and engageable by the fastener head to be moved toward the terminal member surface for clamping at least one wire thereagainst. The washer member has an undersurface facing the flat terminal member surface, said undersurface including rib means defining at least two spaced apart protruding surfaces for bitingly engaging the wire in multi-point contact in response to advancement of the washer toward the terminal member by the screw.

BRIEF DESCRIPTION OF THE DRAWINGS

Other objects, features and advantages of the invention will be appreciated upon consideration of the following detailed description of the illustrated embodiment together with reference to the accompanying drawings, wherein.

DETAILED DESCRIPTION OF THE ILLUSTRATED EMBODIMENT

Figure 1:
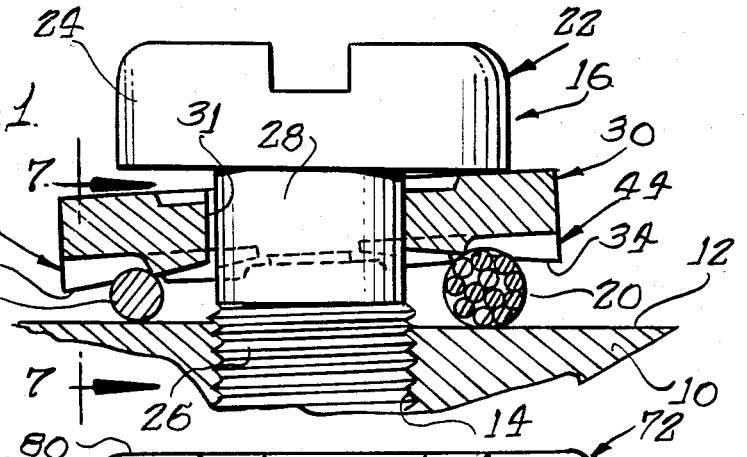
FIG. 1 is a side elevation, partially in section, of a wire clamp assembly in accordance with this invention in conjunction with a pair of wires and a portion of a terminal member.

Referring to the drawings and initially to FIG. 1, there is illustrated a support or terminal block 10 of conventional form. As illustrated, this terminal block 10 includes a substantially flat plate-like conductive surface 12 and an internally threaded aperture 14 for receiving a wire clamp or terminal assembly designated generally 16 constructed in accordance with this invention. A pair of wires 18 and 20 which are to be mechanically and electrically joined by use of the wire clamp assembly 16 and terminal member 10 are also illustrated. For purposes of illustrating the versatility of the invention in accomodating wires of different sizes or type, the wire 18 as illustrated is of smaller diameter than the wire 20. It will be understood, however, that the wire clamp assembly 16 of this invention is suitable for use wth a considerable variety of different guages or sizes of wires, as well as with wires of both the solid and stranded variety, the wires 18 and 20 being shown by way of example only.

The wire clamp or terminal assembly 16 includes a screw member 22 comprising a head or driver portion 24, and externally threaded shank portion 26 for engagement with the thread 14 of the terminal block member 10. An unthreaded shank portion 28 is provided intermediate the head 24 and threaded shank portion 26. A clamping member 30 in the form of a washer-like member having a central through aperture 32 is carried by the fastener 22. Preferably, this clamping member 30 is held captive on the unthreaded shank portion 28 by the thread on the shank portion 26. For example, the screw 22 may be formed from a screw blank in conventional fashion and the threaded shank portion 26 formed by rolling or other suitable means. The washer member 30 is then disposed over the unthreaded shank portion 28 prior to formation of the threaded shank portion 26, whereby the major diameter of the threads formed thereon are larger than the diameter of the unthreaded shank portion 28 and also larger than the central aperture 32 of the washer 30. Accordingly the clamping member or washer 30 is held in captive relation on the screw 22. However, the diameter of the central aperture 31 is preferably somewhat greater than the outer diameter of the unthreaded shank portion 28 to permit the "tilting" movement required in accomodating wires of different sizes.

From the foregoing and as viewed in FIG. 1, the length of the unthreaded shank portion 28 and diameter of the central aperture 31 are such as to permit some degree of freedom of movement of the washer or clamping member 30 with respect to the unthreaded shank portion 28. When the fastener 22 is partially withdrawn from the terminal 12, the washer 30 will be raised somewhat. The foregoing structure, together with the slight freedom of movement permitted the washer as described above enables the wires 18 and 20 to be positioned for clamping when the screw 22 is partially withdrawn from the threaded aperture 14 of the terminal block 10.

Figure 2:
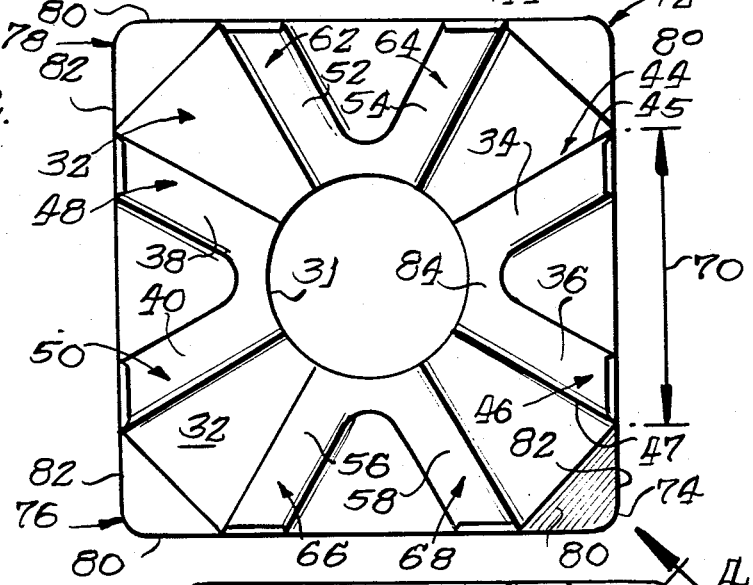
FIG. 2 is a view of the undersurface of the clamping washer portion of the wire clamp assembly of this invention.

Referring now to FIGS. 2 through 5, in the illustrated embodiment the washer or clamping member 30 is generally polygonal and includes an undersurface 32, FIG. 2 which faces the flat surface 12 of the terminal member 10. In order to positively engage or grip the wires 18 and 20, diametrically opposed pairs of protruding or raised rib members 44, 46 and 48, 50 which serve to define gripping surfaces 34, 36 and 38, 40 on the undersurface or underside 32 of the washer 30. In the illustrated embodiment, the surfaces 34, 36 and 38, 40 are formed on the upper surfaces of the corresponding pairs of rib members 44, 46 and 48, 50, which rib members extend outwardly from an area adjacent the central aperture 28 to the outer peripheral area of the washer 30. These pairs of ribs and corresponding protruding surfaces are formed on the undersurface 32 of the clamping member 30 by deforming the body of the member as by stamping, coining or other suitable means.

In the illustrated embodiment, the ribs and corresponding raised surfaces are preferably formed substantially symmetrically with respect to the mid points of the opposing side surfaces or peripheries of the washer 30. Additionally, in the illustrated embodiment two further diametrically opposed pairs of raised or protruding rib members 62, 64 and 66, 68 are provided, which rib members define gripping surfaces 52, 54 and 56, 58, also substantially symmetrically disposed about the remaining two sides of the washer 30. It should be noted that in the preferred illustrated embodiment the pairs of rib members 44, 46; 48, 50; 62, 64; and 66, 68 are disposed generally in a radial orientation with respect to each other and the center of the aperture 31, for a purpose to be detailed more fully hereinafter. Accordingly, the undersurface 32 of the washer 30 is substantially symmetrically formed wth the pairs of raised gripping surfaces as described, whereby the washer 30 may be oriented in either direction with respect to the wires 18 and 20 for achieving clamping action therewith.

Preferably, the outermost ends of the side surfaces (e.g. 45, 47) of the respective pairs of ribs 44, 46, etc. are spaced apart by a dimension 70, FIG. 2, which is at least equal to and preferably greater than the diameter of the central aperture 31. Accordingly, upon assembly as illustrated in FIG. 1 a stop or limit is provided by these outer edges 45, 47, etc. for the respective wires 18 and 20, thus prevents excessive contact thereof with the threads 26 of the screw 22.

Figure 4:
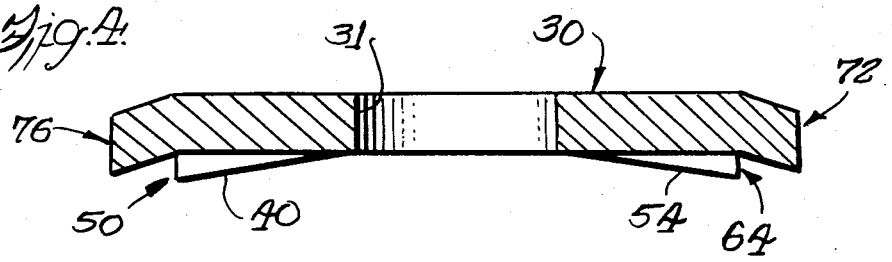
FIG. 4 is a sectional view taken generally in the plane of the line 4—4 of FIG. 3.
Figure 5:
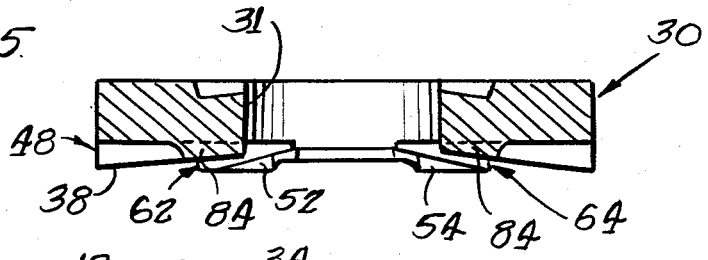
FIG. 5 is a sectional view taken generally in the plane of the line 5—5 of FIG. 3.

Referring to FIGS. 4 and 5, it will be seen that the respective ribs 44, 46 and hence the surfaces 34, 36, etc. defined thereby are preferably ramped or sloped with respect to the undersurface 32 of the washer 30. That is, each of the ribs and its corresponding protruding surface is formed with a slope or ramp whose height generally increases from the area adjacent the through aperture 31 in the direction toward the periphery of the washer 30. Advantageously, this sloping or ramping of the respective ribs in conjunction with the radial disposition of the ribs tends to localize the application of force to the wires and is more efficient in urging the respective wires 18 and 20 generally radially inwardly. This concentration of force assures positive engagement and gripping of the wires during assembly. However, as mentioned above, the outer side surfaces of the complimentary diametrically opposed pairs of ribs provide a limit or stop to this movement, thus producing a bend or "kink" in the wire which enhances pull-out resistance.

As also shown in the illustrated embodiment, the respective pairs of ribs 44, 46, etc. preferably diverge as they proceed from the area adjacent the through aperture 31 to the periphery of the washer 30. Hence, as best viewed in FIG. 6, each of the pairs of ribs diverge in a generally radial direction.

In accordance with a further preferred feature of the invention, the ribs 44, 46 etc. are each preferably generally rectangular in cross section. That is, each rib defines a pair of relatively angular edge parts 71, 73 intermediate the protruding ramped surfaces 34, 36, etc. and adjacent side surfaces 45, 47, etc. The provision of these relatively angularly edge parts 71, 73, etc. produces positive biting engagement with the wires 18, 20. This biting action is illustrated, for example, in FIG. 8.

With further reference to FIGS. 2 through 6, attention is now directed to the respective corners 72, 74, 76 and 78 of the substantially square washer or clamping member 30. It will be noted that these corners are deflected or bent inwardly, that is in the direction away from the driver head 24 of the screw 22 and toward the facing surface 12 of the terminal block member 10. Accordingly, each said corner provides a pair of edges, for example 80, 82, FIGS. 2 and 6 which will further engage and bite into the wire 18 or 20 to prevent pull-out. Preferably, and as illustrated, these corners are deformed or bent over about a line which extends substantially between the outer peripheries of respective successive ribs, 44 and 64, for example. In addition to biting into the associated wire 18 or 20, the edges 80, 82 also serve to urge the wires inwardly. As such, the edges 80, 82 cooperate with the ribs 44, 46 etc. to force the wire 18 or 20 radially inward into engagement with the lateral edges of the adjacent rib members. For example, with reference to FIG. 7 rib member 62 and 64 along with the edges of corners 72 and 78 serve to force wire 18 radially inward against the lateral edges of the rib member 44 and 48. The rib members 44 and 48 acting as stop or limit means to prevent the wire 18 from excessive engagement with the screw 22. The points of gripping or biting engagement of the washer 30 with this wire 18 are illustrated with respect to an exemplary wire segment in FIG. 7 for example, to which reference is also invited.

As also viewed in FIG. 2, the respective ribs 44, 46, etc. are joined at their innermost ends by small webs 84, which protrude slightly from the surface 32 of the washer 30. Preferably these webs 84 are substantially coplanar with the innermost ends of the surfaces 34 and 36, etc. of the ribs 44 and 46, etc. which they join.

Figure 6:
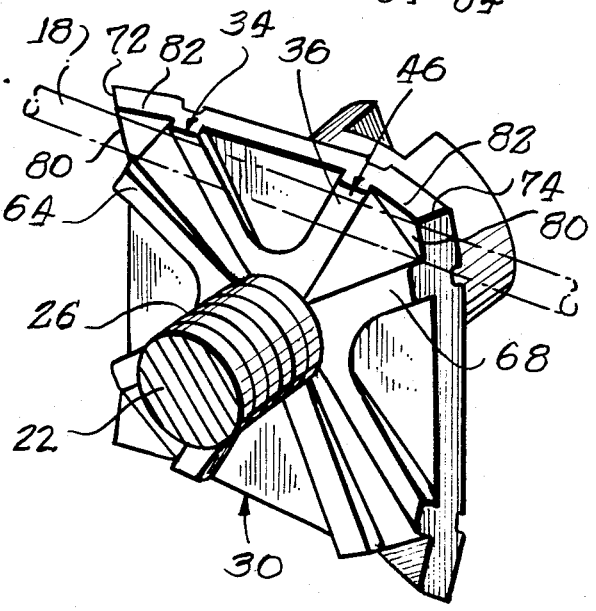
FIG. 6 is a bottom perspective view of a screw and washer wire clamp assembly according to this invention.

Consideration is now directed to the operation of the assembly 16, with reference to FIG. 1 and FIG. 6, with respect to the clamping of the wire members 18 and 20. In this regard, the fastener 22 is initially backed out of the aperture 14 in the block 10. Due to the captive mounting of the clamping member 30 on fastener 22, it will be raised relative to the surface 12 of the block 10, thus facilitating an initial positioning of respective wires 18 and 20. Once these wires 18 and 20 are positioned, the fastener 22 may be driven inwardly by rotatable engagement of a suitable tool with the driver head portion 24 to effect clamped engagement.

It can be seen that as the fastener 22 advances the radially disposed ramped surfaces 34, 36 etc. engage the wires 18 and 20, as do the edges 80 and 82. Advantageously, it will be noted that these sloping or ramped surfaces 34, 36 cooperate in conjunction with edges 80 and 82 to urge the wires 18 and 20 inwardly toward the central aperture 31 and the screw member 22 as the washer or clamping member 30 is advanced with respect to the terminal member 10. Importantly, however the second pairs of diametrically opposed ridges or ribs provide a limit or stop to this inward movement avoiding excessive contact of the wires 18 and 20 with the thread 26 of the fastener 22, and producing the above discussed slight bend in the wire. It should be noted that while slight contact may be permitted, excessive contact could lead to damage of the wire 18 or 20, most particularly where one of these is a "strand" type wire. As previously mentioned the provision of the sharply angled and preferably rectangular cross-sectional configuration of the respective ribs 44, 46, etc. enhances biting engagement with respective wires 18 and 20 as illustrated for example in FIGS. 7 and 8.

Figure 7:
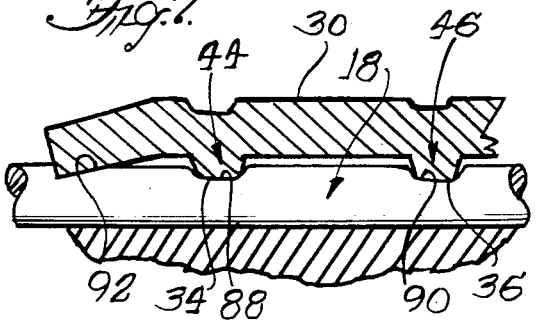
FIG. 7 is an enlarged partial sectional view taken generally along the line 7—7 of FIG. 1, further illustrating the multi-location contact attainable with the wire clamp assembly according to this invention.
Figure 8:
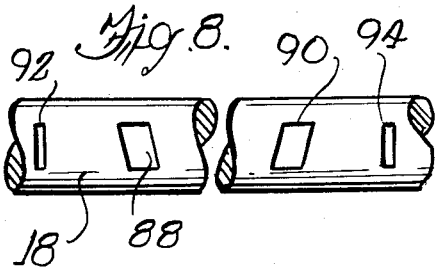
FIG. 8 is a top plane view of a wire or conductor illustrating the clamping action of the wire clamp assembly in accordance with this invention.

Importantly, the provision of paired radial ribs 44, 46 provide what is herein referred to as "multi-point" engagement, of the type illustrated in FIGS. 7 and 8 for example with the respective wires 18 and 22. This multi-point engagement defines a pair of points of engagement 88 and 90 defined by the rib members and a second pair of points of engagement 92, 94 at the location where the edges 80, 82 engage the wire. Accordingly the clamping force applied by the washer is applied over a small area thereby increasing the force per unit of area. This localization of the clamping force serves to provide the assembly with high resistance to pull-out, and additionally greatly enhances resistance to movement in response to torque or swiveling forces applied to the wire.

Directing attention again to FIG. 4, it will be noted that the inward extent of the respective bent over or inwardly deformed corners 72, 84, etc. is such that the edges 80, 82 defined by the corners remain spaced somewhat above the highest points of the respective ramp surfaces 34, 36, etc. Hence, the initial inward urging and gripping engagement of the respective wires 18, 20 by the respective ramps or protruding surfaces 34, 36, etc. will occur prior to contact of the wires by respective edges 80, 82 of the bent over corner portions 72, 74, etc. Accordingly, the ramps 34, 36 will engage the wire and effect initial inward movement, with the edges 80, 82 etc. of the corners 72, 74, etc. thereafter engaging the wire 18 or 20 to further urge the wire inwardly. These edges 80, 82, etc. of the corners 72, 74, etc. also serve to bite into the respective surfaces of the wires 18, 20 to increase the gripping inability of the wire clamp assembly.

Accordingly, as illustrated in FIGS. 7 and 8, as many as four points of gripping or biting engagement are defined by the edge portions and ribs of the clamping member of washer 30 along the length of each of the wires 18 and 20. It will be appreciated, then, that the cooperation of the pairs of ribs or ramps and downwardly turned corners tend to align the wires 18 and 20 substantially parallel with each other at opposite sides of the screw member 22. Advantageously, then, the symmetrical arrangement of the respective ribs and corners facilitates the desired alignment and consequent gripping engagement of the wires 18 and 20. Moreover, this symmetrical arrangement permits similar engagement and clamping of wires by the washer 30 when oriented at a 90 degree rotated position from that illustrated.

Figure 3:
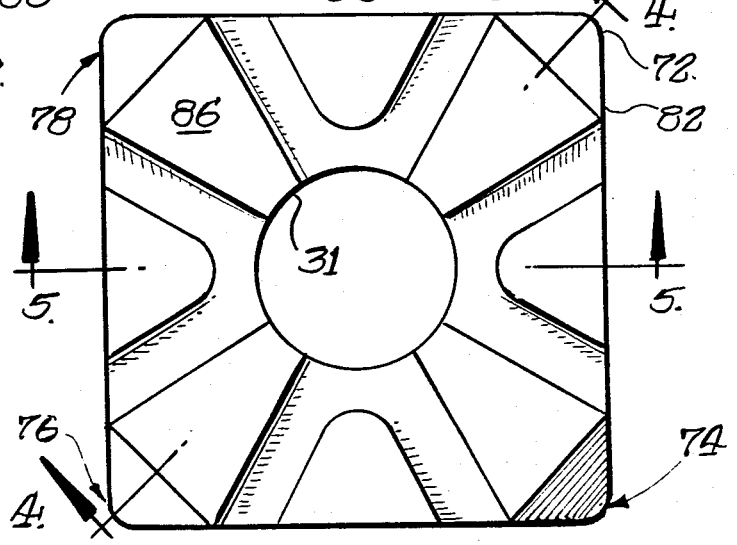
FIG. 3 is a top view of the clamping washer portion of FIG. 2.

Referring again briefly to FIGS. 2 and 3, it will be noted that the respective ribs 44, and down turned edges 72, 74, etc. may be simply an inexpensively formed in the clamping member or washer 30 by a single conventional stamping or coining operation. Moreover, it will be noted that such formation of the ribs and corners results in a complimentary form being imparted to the opposite surface 86 of the washer 30 facing the head or driver portion 24 of the screw member 22. Hence, as shown in FIG. 3, corresponding valleys or hollowed portions are formed on the surface 86 which correspond with the ramps or ridges 44, 46 described above.

As best seen in FIG. 1, the engagement or bearing surface defined between the head portion 24 of the screw 22 and the top surface 86 of the washer 30 is substantially radially inwardly of the point of engagement of the ribs 44, 46, etc. with the wires 18 and 20. Accordingly, the larger wire 20 tends to cause the washer or clamping member 30 to assume a somewhat tilted position with respect to the axis of the screw 22 for engaging the smaller wire 18. The diameter of the central aperture 32 of the washer 30 as mentioned above is sufficiently large with respect to the shank 28 of the screw 22 to permit the relative movement required to attain this tilting action. Since the bearing of the screw head 24 upon the washer 30 is generally radially inwardly of the engagement of the washer 30 with the wire 20 it will be appreciated that tilting in the opposite direction, the wire 20 acting as a fulcrum, is not possible. Hence, initial engagement of the diametrically opposed ribs 38, 40 with the smaller wire such as the wire 18 is encouraged. In the case where two wires of equal diameter are to be engaged, such tilting is of course not present, the opposing pairs of ribs simultaneously engaging and clamping both wires.

What has been shown and described herein is a wire clamp assembly adapted for positioning and clamping either a single wire or a pair of wires substantially in parallel alignment, to form a good mechanical and electrical connection with a terminal member. The illustrated and described clamping member or washer further provides two points of biting engagement with each wire being clamped thereby, thus substantially preventing movement of the wire in any direction once clamped. It will be particularly noted that such biting engagement at two points renders the assembly especially resistant to pulling out of the wires once clamped therein. Additionally, further points of contact are achieved upon clamping, as noted above, by the edges of the respective down turned corner portions, thus further resisting movement in any direction of the wire once clamped. The described wire clamp assembly is further adapted for engaging a pair of wires of either solid or stranded configuration, and of different gauges or relative sizes over a considerable range of wire gauges.

While a preferred embodiment has been illustrated and described herein, the invention is not limited thereto. Rather, the invention is intended to embrace all such changes, alternatives and modifications as may occur to those skilled in the art upon reading the foregoing, insofar as such changes, alternatives and modifications fall within the spirit and scope of the appended claims.

The invention is claimed as follows:

1. A wire clamp assembly for use with an internally threaded terminal member, said wire clamp assembly comprising in combination: a screw member having an externally threaded shank portion for engagement with said internal thread of said terminal member, a driver head, and an unthreaded shank portion intermediate said head and said threaded shank portion; and a polygonal plate-like washer member having a central aperture and mounted upon said unthreaded shank portion, the plate-like washer member being engageable by said driver head to be moved toward said terminal member for clamping at least one wire therebetween, said washer member having an undersurface for facing said terminal member and a plurality of sides which meet to define corners, said undersurface including rib means associated with at least one side of said polygonal plate-like washer member, said rib means being defined by a pair of spaced apart rib members, each said rib member being disposed substantially radially with respect to the axis of said central aperture in the washer member, and each said rib member extending from an area generally adjacent said central aperture toward the periphery of said one side, said pair of rib members diverging in a direction away from the central aperture and toward said periphery, said rib members intersecting the said one side at spaced locations, both of said locations being intermediate the corners associated with said one side, each said rib member defining a ramp surface protruding from the undersurface of the washer member, said ramp surface gradually increasing in height in a direction from said central aperture toward said periphery, such that said rib members will bitingly engage a wire to be retained thereby in multi-location contact while urging said wire inwardly toward said central aperture in response to advancement of said washer member toward said terminal member by said screw member.

2. A wire clamp assembly according to claim 1, wherein the washer member includes corner defining portions which are turned downwardly in the direction of protrusion of the rib members, with the locations of the intersection of said washer member sides by the rib members being intermediate the downwardly turned corner defining portions, and each downwardly turned corner defining portion providing a pair of edges which will engage a wire to be retained by the wire clamp assembly.

3. A wire clamp assembly according to claim 1, wherein each said rib member includes a pair of edges to enhance the biting engagement of the rib member with a wire.

4. A wire clamp assembly according to claim 3, wherein the polygonal plate-like washer has four sides and four associated corners, and there is provided a pair of rib members associated with each said side.

5. A wire clamp assembly according to claim 4, wherein the spacing between the remote edges of the rib members at the locations where said rib members intersect the periphery of the washer member sides being greater than the diameter of said central aperture, thereby to prevent excessive engagement of a wire with the screw member.

6. A wire clamp assembly according to claim 1, wherein the polygonal plate-like washer member has four sides and four corners, and there is provided a pair of rib members associated with at least a pair of opposite sides.

7. A wire clamp assembly according to claim 6, wherein there is provided a pair of rib members associated with each side.

8. A clamping member for use in a wire clamp assembly which includes a screw member having the clamping member mounted thereon and is used for retaining a wire in conductive association with a terminal member to which the screw member is attached, said clamping member being in the form of a polygonal plate-like washer member having a central aperture for mounting said washer member upon said screw member, said washer member including an undersurface for facing said terminal member and a plurality of sides which meet to define corners, said undersurface of the washer member including rib means associated with at least one side of said washer member, said rib means being defined by a pair of spaced apart rib members, each said rib member being disposed substantially radially with respect to the axis of said central aperture in the washer member, and each said rib member extending from an area generally adjacent said central aperture toward the periphery of said one side, said pair of rib members diverging in a direction away from the central aperture and toward said periphery, said rib members intersecting the said one side at spaced locations, both of said locations being intermediate the corners associated with said one side, each said rib member defining a ramp surface protruding from the undersurface of the washer member, said ramp surface gradually increasing in height in a direction from said central aperture toward said periphery, such that said rib members will bitingly engage a wire to be retained thereby in multi-location contact while urging said wire inwardly toward said central aperture when said clamping member is mounted to a screw member which in turn is engaged with a terminal member, and said screw member is operated to advance said clamping member toward said terminal member and into engagement with a wire.

9. A clamping member according to claim 8, wherein each said rib member includes a pair of edges to enhance the biting engagement of the rib member with a wire.

10. A clamping member according to claim 9, wherein the polygonal plate-like washer member has four sides and four associated corners, and there is provided a pair of rib members associated with each said side.

11. A wire clamp assembly according to claim 10, wherein the spacing between the remote edges of the rib members at the locations wherein said rib members intersect the periphery of the washer member sides being greater than the diameter of said central aperture.

12. A clamping member according to claim 8, wherein the polygonal plate-like washer member has four sides and four corners, and there is provided a pair of rib members associated with at least a pair of opposite sides.

13. A wire clamp assembly according to claim 12, wherein there is provided a pair of rib members associated with each side.

14. A wire clamp assembly according to claim 12, wherein the washer member includes corner defining portions which are turned downwardly in the direction of protrusion of the rib members, with the locations of the intersections of said washer member sides by the rib members being intermediate the downwardly turned corner defining portions, and each downwardly turned corner defining portion providing a pair of edges adapted to engage a wire.

* * * * *